US005836153A

United States Patent [19]

Staufenberg et al.

[11] Patent Number: 5,836,153

[45] Date of Patent: Nov. 17, 1998

[54] METHOD FOR CONTROLLING THE FUEL-AIR RATIO OF AN INTERNAL COMBUSTION ENGINE

[75] Inventors: Ulrich Staufenberg, Diethardt; Peter Olejnik, Bad Soden, both of Germany

[73] Assignee: VDO Adolf Schindling AG, Frankfurt, Germany

[21] Appl. No.: 762,120

[22] Filed: Dec. 5, 1996

[30] Foreign Application Priority Data

Dec. 7, 1995 [DE] Germany ..... 195 45 694.7

[51] Int. Cl.[6] ..... F02D 41/14

[52] U.S. Cl. ..... 60/274; 60/276; 60/285; 123/696

[58] Field of Search ..... 60/274, 276, 285; 123/694, 696

[56] References Cited

U.S. PATENT DOCUMENTS 5,307,625 5/1994 Junginger et al. ..... 123/696 X 5,379,591 1/1995 Iwata et al. ..... 60/285 X

*Primary Examiner*—Tony M. Argenbright

*Attorney, Agent, or Firm*—Martin A. Farber

[57] ABSTRACT

A method for controlling the fuel-air ratio of an internal combustion engine in which the output signal of a first lambda probe, which is arranged in front of a catalytic converter in the exhaust pipe of the internal combustion engine, is fed to a controller. The controller gives off a setting variable for the fuel-air ratio, and a further signal which is obtained from the output signal of a second lambda probe arranged behind the catalytic converter is fed to the controller. In order to permit an accurate and adjustable control which further improves the fuel-air ratio in the sense of a reduction of the exhaust emission, a hold time is obtained on the output signal of the second lambda probe as a function of the time of the reversal of the output signal of the first lambda probe, whereby the output signal of the controller is shifted in time.

7 Claims, 5 Drawing Sheets

METHOD FOR CONTROLLING THE FUEL-AIR RATIO OF AN INTERNAL COMBUSTION ENGINE

FIELD AND BACKGROUND OF THE INVENTION

The present invention relates to a method for controlling the fuel-air ratio of an internal combustion engine in which the output signal of a first lambda probe, or oxygen measurement probe, which is arranged in front of a catalytic converter in the exhaust pipe of the internal combustion engine, is fed to a controller, and the controller gives off a setting variable for the fuel-air ratio, wherein another signal which is obtained from the output signal of a second lambda (oxygen measurement) probe arranged behind the catalytic converter is fed to the controller.

In order to obtain exhaust gases which are as free as possible of noxious substances, control devices for internal combustion engines are known in which the oxygen content in the exhaust pipe is measured and evaluated. For this purpose, oxygen measurement probes are known, so called lambda probes, which operate, for instance, in accordance with the principle of ionic conduction through a solid electrolyte as a result of a difference in oxygen partial pressure, and give off a voltage signal corresponding to the oxygen partial pressure present in the exhaust gas, and wherein the signal experiences a voltage jump upon transfer from a deficiency of oxygen to an excess of oxygen, or vice versa.

The output signal of the lambda probe is evaluated by a controller which regulates the fuel-air mixture via an actuator.

By the adjustment of the fuel-air ratio there is primarily desired a reduction of the injurious portions of the exhaust emission of internal combustion engines.

By means of a second lambda probe, arranged behind the catalytic converter, the signal of the first lambda probe is corrected, since the probe is subject to aging phenomena.

Despite this superimposed control, the aging phenomena of the first lambda probe cannot be sufficiently corrected.

SUMMARY OF THE INVENTION

It is an object of the invention to provide a method which permits an accurate, adaptable control so that the fuel-air ratio is further improved, in the sense of a reduction in the exhaust emission.

According to the invention, a hold time, whereby the output signal of the controller is offset in time, is obtained from the output signal of the second lambda probe depending on the point in time of the reversal of the output signal of the first lambda probe.

The advantage of the invention is that a setting variable which is dependent on the time for which the output signal of the first lambda probe actually lasts is superimposed on the control system which contains the first lambda probe.

According to a feature of the invention, the output signal of the controller is delayed.

In a further development of the process, a difference, which is integrated, with inclusion of its sign to the time of the reversal of the first lambda probe, is formed between the output signal of the second lambda probe and a desired value, the integrator value being converted into a time.

The desired value advantageously corresponds approximately to the average value of the output signal of the second lambda probe upon disturbance-free operation of the first lambda probe.

For the adjustment of the operating point, the time obtained from the signal of the second lambda probe is corrected as a function of the load and the speed of rotation of the internal combustion engine and fed to the control system in the manner that the fuel injection is adapted.

Another feature of the invention is that, upon a comparison of the desired value with the actual value of the second lambda probe, it is determined, as a function of a difference formed from the desired and actual values whether the first or a second proportionality constant is used for the determination of the hold time.

A further feature of the invention is that the value of the signal to be fed to the controller is dependent on the load and/or the speed of rotation of the internal combustion engine.

BRIEF DESCRIPTION OF THE DRAWINGS

With the above and other objects and advantages in view, the present invention will become more clearly understood in connection with the detailed description of preferred embodiments, when considered with the accompanying drawings, of which.

DETAILED DESCRIPTION OF THE PREFERRED EMBODIMENTS

Figure 1:
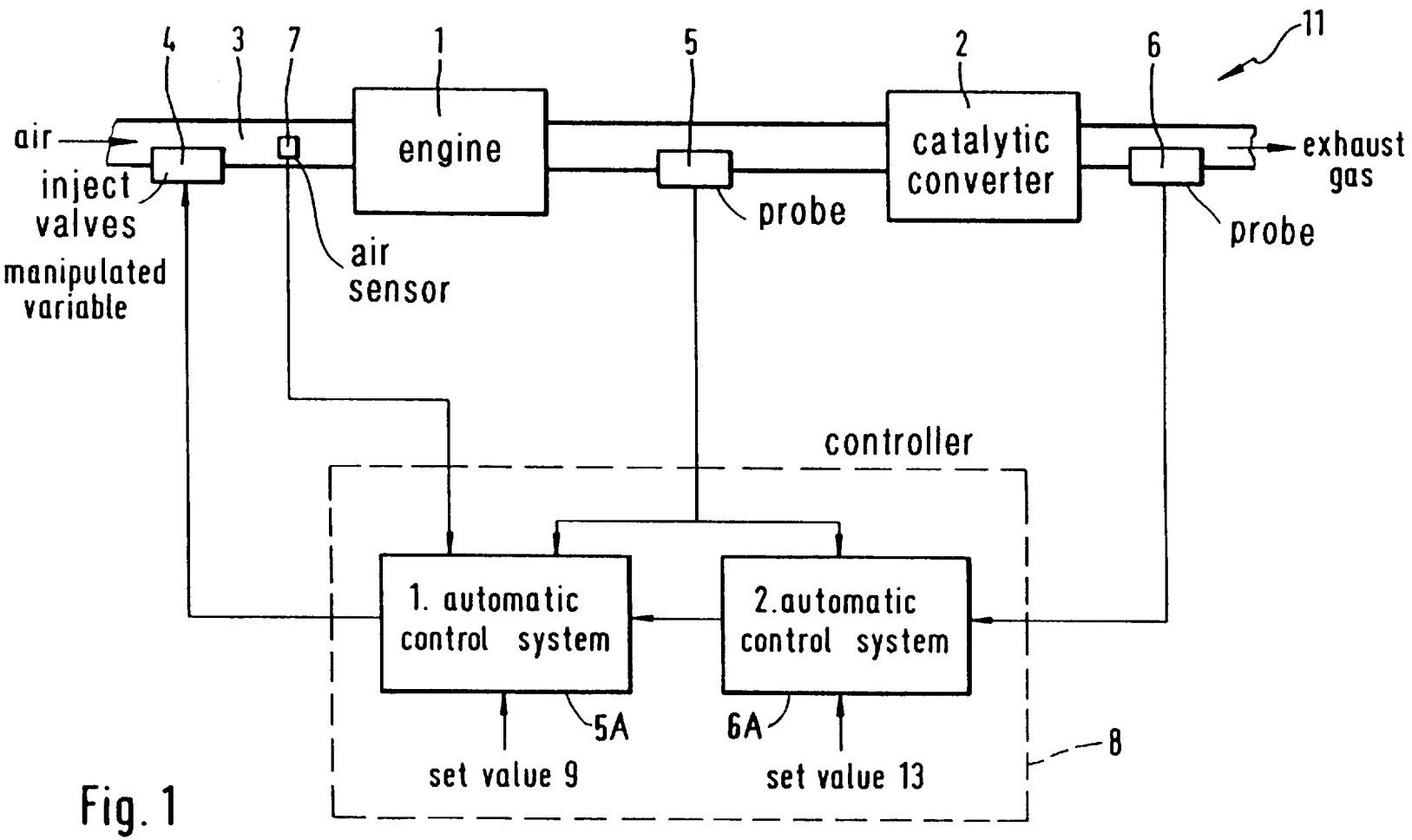
FIG. 1 is a diagram of a device for controlling the fuel-air mixture for an internal combustion engine.

In accordance with FIG. 1, the apparatus comprises an internal combustion engine 1 having a catalytic converter 2. Air is fed to the engine 1 via an intake pipe 3. The fuel is injected into the intake pipe 3 via injection valves 4. Between the engine 1 and the catalytic converter 2 there is a first lambda probe 5 for detecting the engine exhaust gas. A further lambda probe 6 is arranged behind the catalytic converter 2 in the exhaust pipe. The lambda probes 5 and 6 measure the instantaneous lambda value of the exhaust gas in front of and behind the catalytic converter 2. Both of the signals delivered by the lambda probes 5 and 6 are conducted to a controller 8 with PI-characteristic (proportional integral, which is ordinarily arranged in a control device (not shown in detail) in the motor vehicle.

From these signals the controller 8 forms, with the help of desired or set values 9, 13, a setting signal (manipulated variable) as an actuation signal which is fed to the injection valves 4. The controller 8 includes a first control system in the form of a control circuit 5A which includes the first lambda probe 5, and a second control system in the form of a control circuit 6A which includes the second lambda probe 6 and connects with the first lambda probe 5.

This setting signal results in a change in the feed of the fuel, which, together with the mass of air drawn in (air quantity meter 7), results in a certain lambda value of the exhaust gas.

Figure 2:
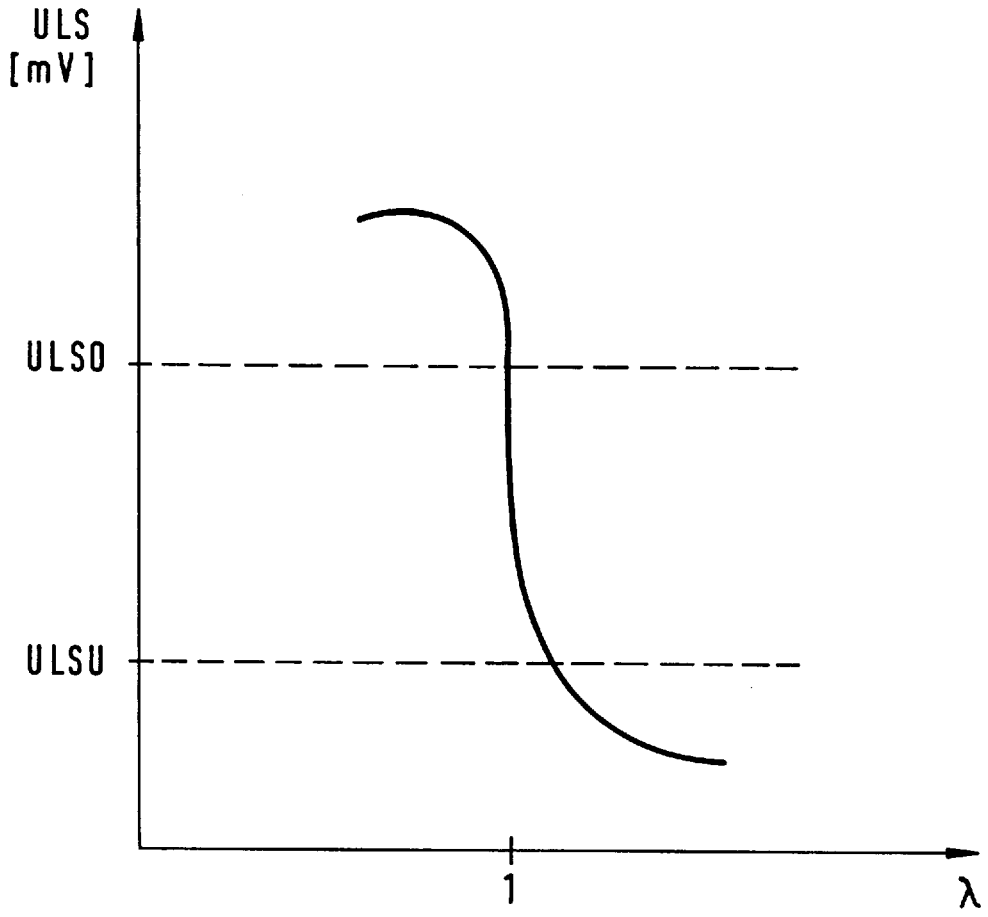
FIG. 2 is a voltage curve of a lambda probe plotted over the fuel-air mixture ($\lambda$ factor)

Each lambda probe supplies a signal of the course shown in FIG. 2 as a function of the λ factor which represents the corresponding fuel-air mixture. Depending on what type of lambda probe is used for the control, either the resistance or the voltage plotted over the λ factor can be considered.

The following remarks refer to the signal voltage.

If the probe is active, it has a signal voltage which lies outside the region (ULSU, ULSO). During the lean deflection, the lambda probe supplies a minimum output signal which lies below ULSU. During the rich deflection, a maximum voltage signal above ULSO in a range of 600–800 mV is measured. This maximum value, due to manufacturing tolerances and aging phenomena, is subject to certain dispersions which are corrected by a probe correction factor.

Figure 3:
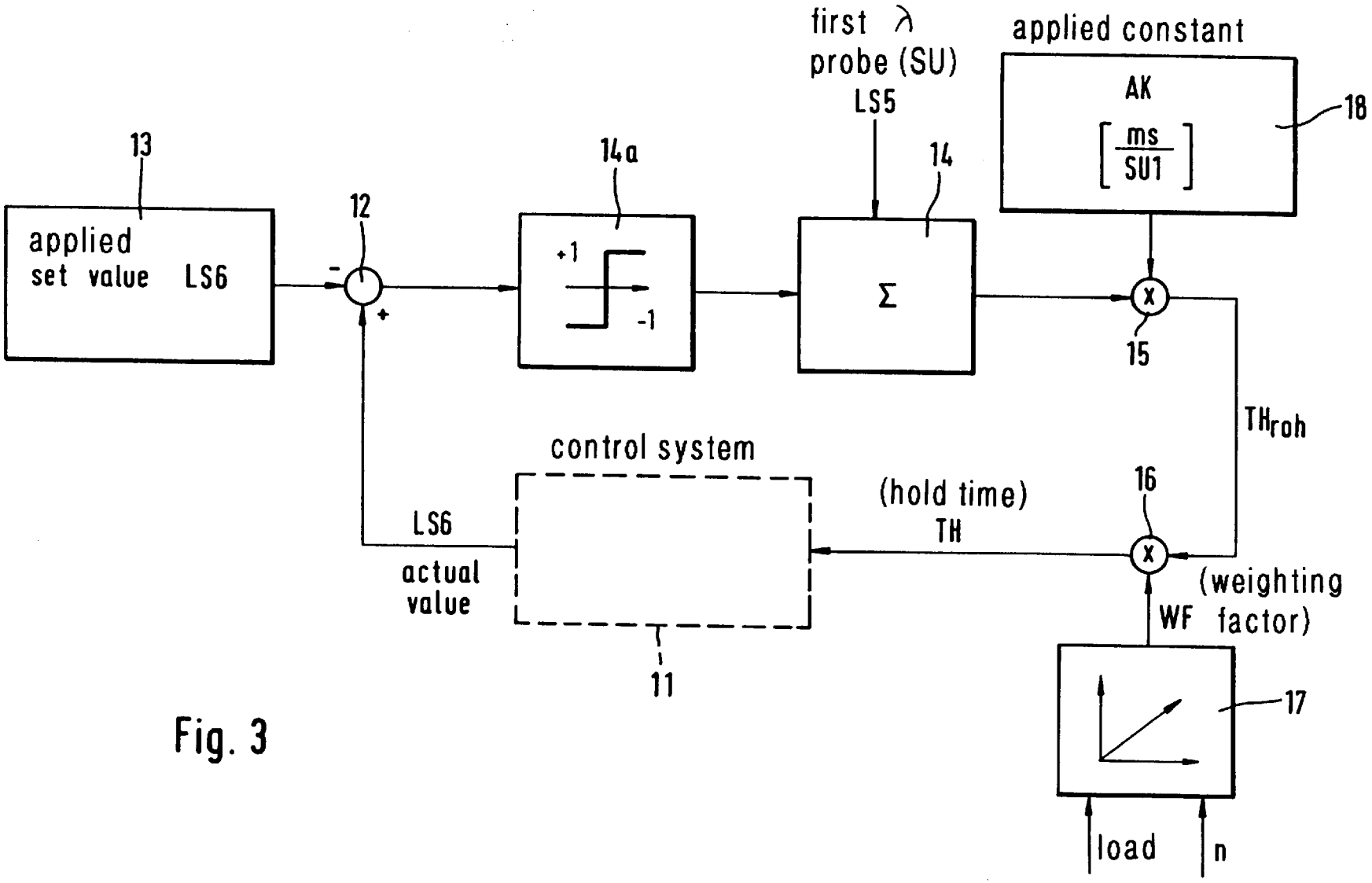
FIG. 3 is a control circuit for the lambda probe located behind the catalytic converter.

In order now to compensate for the long-time drift of the lambda probe 5 in front of the catalytic converter 2, there is employed the second control circuit 6A which includes the second lambda probe 6 behind the catalytic converter 2, and which is explained further in FIG. 3.

As shown in FIG. 1, the control system 11 contains the injection valves 4, the engine 1, the catalytic converter 2, the lambda probe 5 and the lambda probe 6. The controller 8 interrogates both the first control circuit 5A of the lambda probe 5 and the second control circuit 6A of the lambda probe 6, and produces, as result, the actuating setting signal described above.

With reference to FIGS. 1 and 3, the lambda probe 6 arranged behind the catalytic converter 2 in the exhaust pipe supplies a lambda value in the form of a signal voltage. At the start of each control cycle it is checked whether the probe is active. This is done by determining whether this signal voltage is outside a voltage range (ULSU, ULSO). If so, then the actual value ($U_{6ACT}$) measured by the lambda probe 6 is compared at a summation point 12 with a desired value 13 stored in a non-volatile memory of the control device. This desired value ($U_{6DES}$) is formed from the average value measured by the lambda probe 6 when the lambda probe 5 arranged in front of the catalytic converter is operating free of disturbance. A signum counter 14 (operating as an accumulator), with comparator 14*a* arranged in front of it, increments by 1 when the actual value $U_{6ACT}$ is greater than the desired value $U_{6DES}$. It decrements by 1 when the actual value $U_{6ACT}$ is less than the desired value $U_{6DES}$. If the two values are equal, the reading of the counter is not changed.

The signum counter 14 responds, via the comparator 14*a*, to the difference formed at point 12 between the actual value LS6 of the second lambda probe 6 and the desired value 13 of the second lambda probe 6 only as to whether the sign (signum) of this difference is positive or negative. As a function of this sign the signum counter 14 is advanced or set back by 1.

The counter 14 is actuated upon each change of the lambda probe 5 arranged in front of the catalytic converter 2 and is thus clock-controlled by it.

At a first multiplication point 15, the count is multiplied by a proportionality constant provided by unit 18 and having a value of (0.5—several 100) ms/probe change of the first lambda probe, whereby an absolute hold time $TH_{roh}$ is determined. The hold time $TH_{roh}$ thus obtained is evaluated at a second multiplication point 16 with a weighing factor WF which is located in a stored characteristic field 17 as a function of the load and of the speed of rotation n of the engine 1. The hold time TH thus obtained is fed as control variable to the controller 8 of the system 11 for the adjustment of the control system 11.

As an alternative to the determination via the characteristic field 17, the weighting factor WF can also be determined as a function of the period of the first oxygen measurement probe 5.

For this purpose, the measured period $P_{LS5}$ of the first oxygen measurement probe 5 is divided by a constant $P_{LLS5}$ which corresponds to the period of the first probe 5 upon idling.

By comparison with the characteristic fields, in which the weighing factor can assume maximum values of 1, the actual disturbance is now smoothed independently of its size because a kind of self-amplification is achieved by the larger factor. The hold time thus obtained is also fed to the controller 8 for adjustment of the control system 11.

The hold time TH delays the P-jump of the controller 8.

Figure 4:
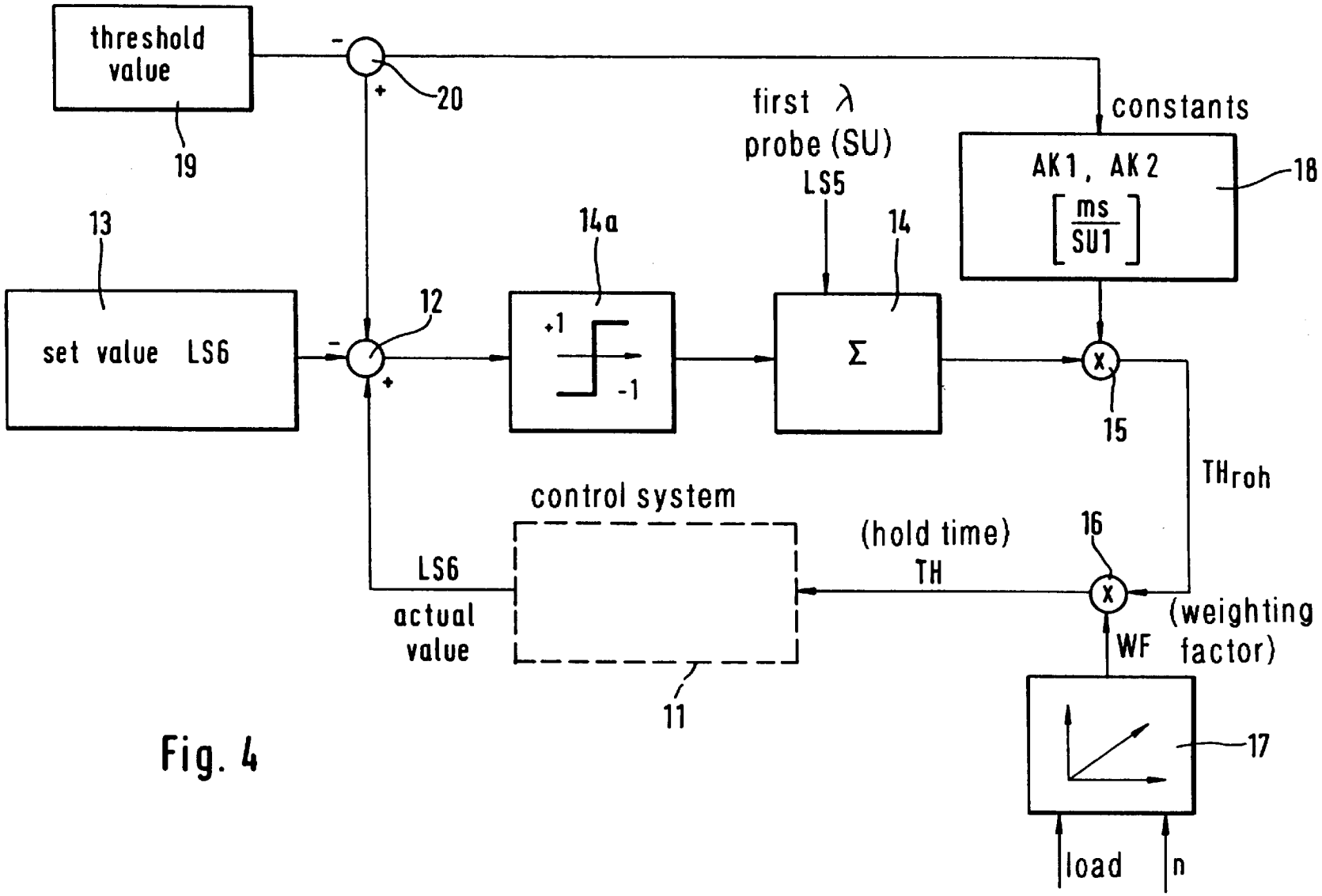
FIG. 4 is a control circuit of the lambda probe with dynamic behavior located behind the catalytic converter.

With reference also to FIG. 4, the dynamic behavior, is based on the comparison of desired value $U_{6DES}$ with actual value $U_{6ACT}$ of the second lambda probe 6 at the summation point 12. A threshold value 19 is subtracted from an output of the summation point 12 to provide a difference amount 20. In order to obtain the dynamic behavior, it is determined whether a first or a second proportionality constant is to be fed to the first multiplication point 15 (FIG. 4). If the amount of the difference between desired value and actual value of the second lambda probe 6, determined by the summation point 12, is less than the threshold value 19, determined by the summation point 20, a first proportionality constant AK1 at unit 18 is selected which establishes a shorter hold time $TH_{roh}$. If the amount of the difference, summation point 12, is greater than the threshold value 19, then a second proportionality constant AK2 at unit 18 is fed by which a longer hold time $TH_{roh}$ is produced. Due to these hold times, the actual value approaches the desired value more or less slowly. Instead of the proportionality constants AK1 and AK2 a characteristic field is also conceivable.

Figures 5, 5A, 5B, 5C:
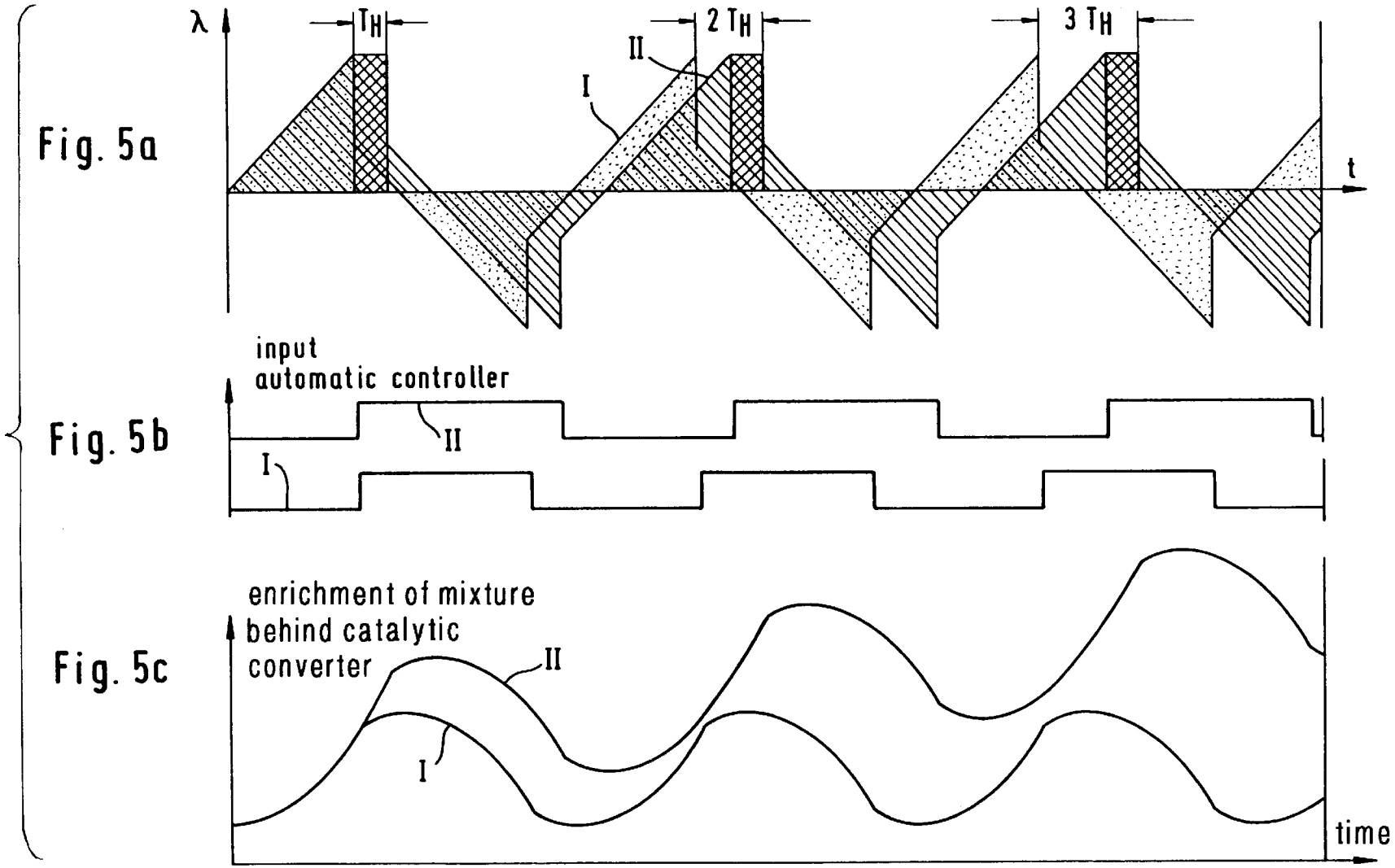
FIG. 5 comprises FIGS. 5*a*, 5*b*, and 5*c*, and is a diagrammatic course of the signal of the control circuits of the lambda probes in front of and behind the catalytic converter.

For better visualization, the influence of this control on the control system 11 is shown in FIG. 5.

In it, the λ control factor is plotted against time.

The curves designated I (dark areas in FIG. 5*a*) show the change with time of the λ control factor without the influence of the control circuit 6A of the second lambda probe 6, while the curves designated II (hatched area in FIG. 5*a*) show the change with time of the lambda control factor under the influence of the control circuit 6A of the lambda probe 6 arranged behind the catalytic converter 2.

This showing is not intended to explain a closed-loop control circuit but serves merely to explain the action of the hold time TH on the first control circuit.

The hold time TH has a sign, in which connection positive times cause a delay in the P-jump of the controller 8 after a lean/rich probe change and negative times cause a delay in the P-jump of the controller 8 after a rich/lean probe change of the lambda probe 5 arranged in front of the catalytic converter 2.

FIG. 5*b* furthermore shows the digitized signal which is given off by the first lambda probe 5 to the input of the controller 8. From a comparison of curves I and II, it can be seen that, under the influence of the second control circuit, the duration of the pulse of the output signal of the first lambda probe 5 is lengthened. As a result, the richness of the mixture behind the catalytic converter continuously increases under the action of the second X control circuit (FIG. 5*c*).

The results of the process described are stored in a non-volatile memory (not shown) of the control device and taken into account in the following control cycles.

As already mentioned, the maximum voltage signal of a lambda probe is subject to certain dispersions which are corrected by a probe correction factor.

The probe correction factor for the lambda probe 6 arranged behind the catalytic converter 2 is determined as follows:

During the start of the internal combustion engine, the catalytic converter 2 is provided with an overly rich fuel-air mixture, which results in an afterburning in the catalytic converter 2. The temperature produced in this way in the catalytic converter 2 is below the operating temperature of the catalytic converter 2, which is normally 200° C. to 300° C. The catalytic converter 2 thus has a greatly limited $O_2$ storage capacity. The prerequisite for the determination of the probe correction factor is that no control circuit is active.

The measurement time $T_{MAX}$ is about 2 minutes and must be concluded before the operating temperature of the catalytic converter 2 is reached.

During the measurement time $T_{MAX}$, the probe voltage ULS6 of the lambda probe 6 arranged behind the catalytic converter 2 is measured several times at equal time intervals.

The measured values $ULS6_n$ are averaged and the average value $LS6_{av}$ is stored in a memory.

The average value $LS6_{av}$ is divided by an applicable constant $LS_{MAX}$.

This applicable constant corresponds to the maximum signal value (rich voltage value) of a reference probe.

The quotient thus determined corresponds to the probe correction factor $LS6_{CORR}$ $$LS6_{CORR} = \frac{LS6_{av}}{LS6_{MAX}}$$

This probe correction factor $LS6_{CORR}$ is used to determine the corrected desired value $U_{DESCORR}$ for the lambda probe 6 arranged behind the catalytic converter:

$$LS6_{DESCORR} = U6_{DES} \times LS6_{CORR}$$

What is claimed is:

1. A method for controlling the fuel-air ratio of an internal combustion engine in which the output signal of a first lambda probe, which is arranged in front of a catalytic converter in the exhaust pipe of the internal combustion engine, is fed to a controller, and the controller gives off a setting variable for the fuel-air ratio, there being another signal which is obtained from the output signal of a second lambda probe arranged behind the catalytic converter and which is fed to the controller, the method comprising steps of:

obtaining a hold time from the output signal of the second lambda probe depending on the point in time of a reversal of the output signal of the first lambda probe;

employing the hold time for offsetting, in time, the output signal of the controller;

producing a count of reversals of the output signal of the first lambda probe;

incrementing a value of the count in at least one of a positive sense and a negative sense according to a comparison of the output signal of the second lambda probe with a reference signal; and in said obtaining step, employing the count for obtaining the hold time.

2. A method according to claim 1, wherein said offsetting provides for delaying the output signal of the controller.

3. A method according to claim 1, further comprising:

comparing the output signal of the second lambda probe with a desired value to form a differences, said difference serving as said comparison;

integrating the difference with inclusion of a sign of the difference to the time of the reversal of the first oxygen measurement probe, said integrating including said steps of producing and incrementing; and converting an integration value of the integrating step into a time.

4. A method according to claim 1, further comprising a step of feeding to the controller a signal having a value dependent on at least one of the load and the speed of rotation of the internal combustion engine.

5. A method for controlling the fuel-air ratio of an internal combustion engine in which the output signal of a first lambda probe, which is arranged in front of a catalytic converter in the exhaust pipe of the internal combustion engine, is fed to a controller, and the controller gives off a setting variable for the fuel-air ratio, there being another signal which is obtained from the output signal of a second lambda probe arranged behind the catalytic converter and which is fed to the controller, the method comprising steps of:

obtaining a hold time from the output signal of the second lambda probe depending on the point in time of a reversal of the output signal of the first lambda probe;

employing the hold time for offsetting the output signal of the controller, said offsetting providing for delaying the output signal of the controller;

comparing the output signal of the second lambda probe with a desired value to form a difference;

integrating the difference with inclusion of a sign of the difference to the time of the reversal of the first oxygen measurement probe;

converting an integration value of the integrating step into a time;

wherein the desired value represents approximately an average value of the output signal of the second lambda probe upon disturbance-free operation of the first lambda probe.

6. A method for controlling the fuel-air ratio of an internal combustion engine in which the output signal of a first lambda probe, which is arranged in front of a catalytic converter in the exhaust pipe of the internal combustion engine, is fed to a controller, and the controller gives off a setting variable for the fuel-air ratio, there being another signal which is obtained from the output signal of a second lambda probe arranged behind the catalytic converter and which is fed to the controller, the method comprising steps of:

obtaining a hold time from the output signal of the second lambda probe depending on the point in time of a reversal of the output signal of the first lambda probe;

employing the hold time for offsetting the output signal of the controller, said offsetting providing for delaying the output signal of the controller;

comparing the output signal of the second lambda probe with a desired value to form a difference;

integrating the difference with inclusion of a sign of the difference to the time of the reversal of the first oxygen measurement probe;

converting an integration value of the integrating step into a time;

wherein subsequent to said comparing of the desired value with the actual value of the second lambda probe, there is a step of determining as a function of a difference formed between the desired and actual values, whether a first or a second proportionality constant is to be used for establishing a value of the hold time.

7. A method for controlling the fuel-air ratio of an internal combustion engine in which the output signal of a first lambda probe, which is arranged in front of a catalytic converter in the exhaust pipe of the internal combustion engine, is fed to a controller, and the controller gives off a setting variable for the fuel-air ratio, there being another signal which is obtained from the output signal of a second lambda probe arranged behind the catalytic converter and which is fed to the controller, the method comprising steps of:

obtaining a hold time from the output signal of the second lambda probe depending on the point in time of a reversal of the output signal of the first lambda probe;

employing the hold time for temporally offsetting the output signal of the controller;

comparing the output signal of the second lambda probe with a desired value to form a difference signal; and wherein said difference signal is employed in said step of obtaining the hold time upon each reversal of the output signal of the first lambda probe.

* * * * *